US010349186B2

(12) United States Patent
Zhan et al.

(10) Patent No.: US 10,349,186 B2
(45) Date of Patent: Jul. 9, 2019

(54) MEMS MICROPHONE

(71) Applicant: Goertek Inc., Shandong (CN)

(72) Inventors: Junkai Zhan, Shandong (CN); Mengjin Cai, Shandong (CN); Zonglin Zhou, Shandong (CN)

(73) Assignee: Goertek Inc., Shandong (CN)

( * ) Notice: Subject to any disclaimer, the term of this patent is extended or adjusted under 35 U.S.C. 154(b) by 0 days.

(21) Appl. No.: 15/743,509

(22) PCT Filed: May 25, 2017

(86) PCT No.: PCT/CN2017/085995

§ 371 (c)(1),
(2) Date: Jan. 10, 2018

(87) PCT Pub. No.: WO2018/209727

PCT Pub. Date: Nov. 22, 2018

(65) Prior Publication Data

US 2019/0028814 A1 Jan. 24, 2019

(30) Foreign Application Priority Data

May 15, 2017 (CN) ..... 2017 1 0339052

(51) Int. Cl.

| | |
|---|---|
| ***H04R 19/04*** | (2006.01) |
| ***H04R 7/18*** | (2006.01) |
| ***B06B 1/02*** | (2006.01) |
| ***H04R 19/00*** | (2006.01) |
| ***G10K 9/12*** | (2006.01) |

(Continued)

(52) U.S. Cl.

CPC ..... *H04R 19/04* (2013.01); *B06B 1/0292* (2013.01); *G10K 9/12* (2013.01); *H04R 7/18* (2013.01); *H04R 19/005* (2013.01); *H04R 1/2823* (2013.01); *H04R 7/04* (2013.01);

(Continued)

(58) Field of Classification Search

CPC ... H04R 7/02; H04R 7/04; H04R 7/06; H04R 7/16; H04R 7/18; H04R 7/20; H04R 19/04; H04R 2201/03

See application file for complete search history.

(56) References Cited

U.S. PATENT DOCUMENTS 5,146,435 A * 9/1992 Bernstein ..... G01H 11/06 29/25.42
7,839,052 B2 * 11/2010 Wu ..... B81B 3/0072 181/171

(Continued)

*Primary Examiner* — Joshua Kaufman
(74) *Attorney, Agent, or Firm* — Alston & Bird LLP

(57) ABSTRACT

An MEMS microphone is disclosed, which comprises a substrate and a vibrating diaphragm and a back electrode which are located above the substrate, a plurality of comb tooth parts are formed in edge positions of the vibrating diaphragm, and the plurality of comb tooth parts are distributed in a peripheral direction of the vibrating diaphragm at intervals, wherein a position between every two adjacent comb tooth parts on the vibrating diaphragm is connected to the substrate via an insulating layer; and the comb tooth parts on the vibrating diaphragm are at least partially overlapped with the substrate, and a clearance exists between the comb tooth parts and the substrate and is configured as an airflow circulation channel. The microphone of the present invention has better impact resistance and can avoid intrusion of dust.

10 Claims, 4 Drawing Sheets

(51) Int. Cl.
*H04R 7/04* (2006.01)
*H04R 1/28* (2006.01)
*H04R 31/00* (2006.01)

(52) U.S. Cl.
CPC ..... *H04R 31/003* (2013.01); *H04R 2201/003* (2013.01); *H04R 2207/021* (2013.01)

(56) References Cited

U.S. PATENT DOCUMENTS

| | | | | |
|---|---|---|---|---|
| 9,402,137 | B2 * | 7/2016 | Hsu | H04R 19/005 |
| 9,611,135 | B1 * | 4/2017 | Klein | H02N 2/02 |
| 2007/0190680 | A1 * | 8/2007 | Fukuda | B81C 1/0023 438/50 |
| 2007/0286438 | A1 * | 12/2007 | Hirade | H04R 19/005 381/174 |
| 2010/0124343 | A1 * | 5/2010 | Zhang | H04R 19/005 381/174 |
| 2013/0121509 | A1 * | 5/2013 | Hsu | H04R 19/005 381/104 |
| 2013/0223023 | A1 * | 8/2013 | Dehe | B81B 7/0029 361/752 |
| 2013/0264663 | A1 * | 10/2013 | Dehe | H04R 19/005 257/416 |
| 2015/0001647 | A1 * | 1/2015 | Dehe | B81B 3/0021 257/416 |
| 2018/0077498 | A1 * | 3/2018 | Yoo | H04R 19/04 |
| 2018/0115838 | A1 * | 4/2018 | Zhang | B81B 3/0021 |

* cited by examiner

MEMS MICROPHONE

CROSS-REFERENCE TO RELATED APPLICATIONS

This application is a National Stage Application, filed under 35 U.S.C. § 371, of International Application No. PCT/CN2017/085995, filed on May 25, 2017, which claims priority to Chinese Patent Application No. 201710339052.5, filed on May 15, 2017, the contents of both of which as are hereby incorporated by reference in their entireties.

BACKGROUND

Related Field

The present invention relates to the field of acoustics, and more particularly, relates to a micro electro-mechanical system (MEMS) microphone.

Description of Related Art

MEMS sensing components have been applied widely in consumer electronics. How to accelerate a product production process is a focal point that current component suppliers pay attention to. For example, dust and chippings generated in mobile phone production and assembly processes are directly cleaned by an air gun, which is a solution with the lowest cost at present. Therefore, it is necessary to put forward a large sound pressure or large air pressure anti-blowing improvement solution specific to the MEMS sensor, so that fracture and failure of a microphone caused by cleaning of the air gun in an assembly process are avoided.

A current improvement solution is that a vibrating diaphragm of the MEMS microphone is provided with a pressure relief hole or pressure relief valve structure. But a structure of the pressure relief hole will reduce an effective area of the vibrating diaphragm. The relief valve structure disposed in a middle region of the vibrating diaphragm will be restricted in size, and its pressure relief capacity is limited. Besides, vibration characteristics of the vibrating diaphragm are directly affected, and particularly, low frequency characteristics of the vibrating diaphragm are affected. Dynamic stability of the vibrating diaphragm is relatively poor.

BRIEF SUMMARY

An object of the present invention is to provide a new technical solution of an MEMS microphone.

According to a first aspect of the present invention, there is provided an MEMS microphone, comprising a substrate and comprising a vibrating diaphragm and a back electrode which are located above the substrate; a plurality of comb tooth parts are formed in edge positions of the vibrating diaphragm, and the plurality of comb tooth parts are distributed in a peripheral direction of the vibrating diaphragm at intervals, wherein a position between every two adjacent comb tooth parts on the vibrating diaphragm is connected to the substrate via an insulating layer; and the comb tooth parts on the vibrating diaphragm are at least partially overlapped with the substrate, and a clearance exists between the comb tooth parts and the substrate and is configured as an airflow circulation channel for airflows to pass by.

Optionally, the vibrating diaphragm comprises a vibrating diaphragm main body and a plurality of connecting parts distributed on the edge of the vibrating diaphragm main body at intervals and protruding relatively to the edge of the vibrating diaphragm main body, and the comb tooth parts are disposed in the positions on the vibrating diaphragm main body between every two adjacent connecting parts; and the connecting parts of the vibrating diaphragm are connected to the substrate via an insulating layer.

Optionally, the vibrating diaphragm main body and the connecting parts are integrally formed by an MEMS process.

Optionally, each comb tooth part comprises at least one air escape valve clack formed by etching the vibrating diaphragm.

Optionally, the air escape valve clack is rectangular, sectorial, oval, trapezoid or S-shaped.

Optionally, the air escape valve clack is provided with a sacrificial hole.

Optionally, parts from the comb tooth parts on the vibrating diaphragm to a center of the vibrating diaphragm and the substrate are overlapped together.

Optionally, the clearances between the positions of the comb tooth parts on the vibrating diaphragm and the substrate are 1-2 μm.

Optionally, free ends of the comb tooth parts extend to an outer side edge of the vibrating diaphragm and are flush with the outer side edge of the vibrating diaphragm, or are in an indentation state relative to the outer side edge of the vibrating diaphragm.

Optionally, the free ends of the comb tooth parts are in a radially protruding state relatively to the outer side edge of the vibrating diaphragm.

According to the microphone of the present invention, an airflow circulation channel communicated with outside is formed between a comb tooth part region of the vibrating diaphragm and the substrate, and a sound pressure that the vibrating diaphragm is subjected to can be rapidly relieved by the airflow circulation channel, such that air pressures of inner and outer cavity bodies of the microphone can be rapidly balanced. In addition, the airflow circulation channel can be deformed according to a stress condition per se. Therefore, a size of the airflow circulation channel can be adjusted according to an overload sound pressure applied in real time, and a pressure relief path is provided for protecting the vibrating diaphragm.

The airflow circulation channel of the present invention also realizes regulation of the low frequency performance of the MEMS microphone. Meanwhile, due to a structural design of the vibrating diaphragm, the airflow circulation channel can greatly improve an impact resistance of the microphone, and can effectively shield dust and particles. The damages to chips per se caused by intrusion of the dust and particles can be avoided.

The inventors of the present invention have found that in the prior art, a pressure relief capacity of the structure of a pressure relief hole or pressure relief valve is limited, and the acoustic performance of the microphone will be affected. Thus, the technical task to be realized by the present invention or the technical problem to be solved is not contemplated or predicted by those skilled in the art, so the present invention is a new technical solution.

Other features and advantages of the present invention will become clear according to the detailed description of exemplary embodiments of the present invention with reference to the accompanying drawings.

DETAILED DESCRIPTION OF VARIOUS EMBODIMENTS

In order to enable the technical problem, the adopted technical solution and the obtained technical effects of the present invention to be easily understood, specific embodiments of the present invention are further explained in conjunction with specific accompanying drawings.

Figure 1:
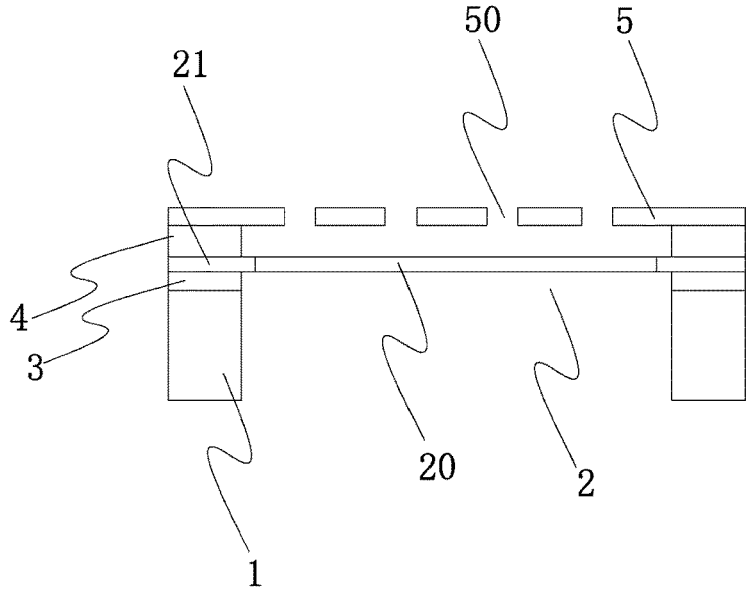
FIG. 1 is a sectional view of connection positions between a microphone and a substrate from a vibrating diaphragm of the present invention.

Referring to FIG. 1, the present invention provides an MEMS microphone, comprising a substrate 1 and a vibrating diaphragm 2 and a back electrode 5 which are located above the substrate 1. A back cavity is formed in a middle region of the substrate 1, and the vibrating diaphragm 2 is supported above the substrate 1 by a first insulating layer 3. Therefore, insulation between the vibrating diaphragm 2 and the substrate 1 is ensured, and a middle region of the vibrating diaphragm 2 is suspended above the back cavity of the substrate 1. The back electrode 5 is provided with a plurality of through holes 50, and is supported above the vibrating diaphragm 2 by a second insulating layer 4. The second insulating layer 4 not only can ensure mutual insulation between the back electrode 5 and the vibrating diaphragm 2, but can also enable a certain clearance to exist between the back electrode 5 and the vibrating diaphragm 2. A capacitor structure capable of converting a sound signal into an electric signal is formed between the back pole 5 and the vibrating diaphragm 2.

The microphone of the present invention is manufactured by adopting an MEMS process. The substrate 1 can adopt a monocrystalline material. The vibrating diaphragm 2 and the back electrode 5 can both adopt a polycrystalline material. The first insulating layer 3 and the second insulating layer 4 can both adopt a silicon dioxide material. The structure of such a microphone and a manufacturing process thereof both belong to the common knowledge of those skilled in the art and are not specifically explained herein.

Figure 2:
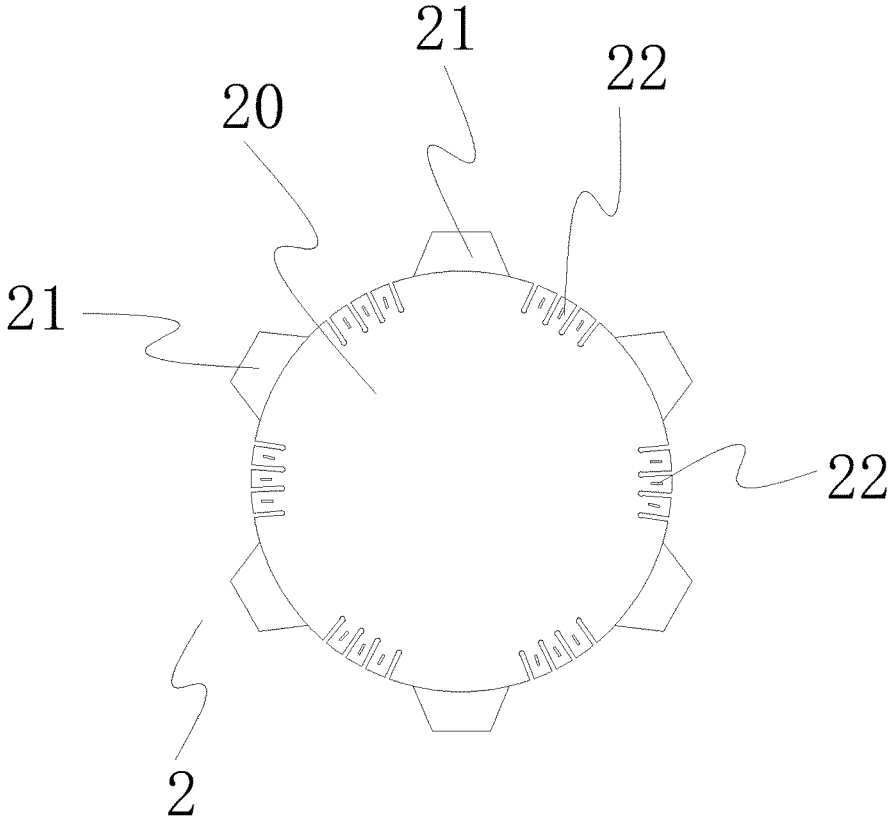
FIG. 2 is structural schematic diagram of a vibrating diaphragm of the present invention.
Figure 3:
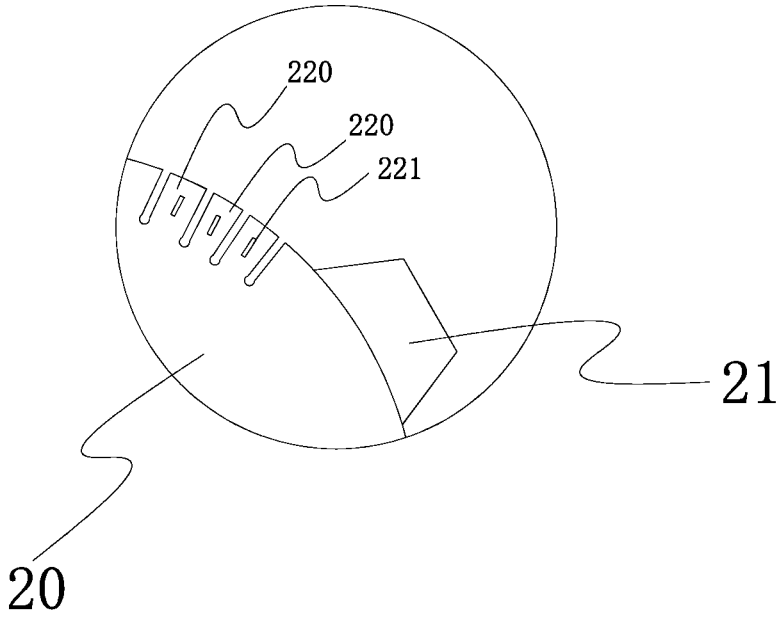
FIG. 3 is a local enlarged view of a comb tooth part in FIG. 2.

Referring to FIGS. 2 and 3, according to the vibrating diaphragm 2 provided by the present invention, a plurality of comb tooth parts 22 are formed in edge positions of the vibrating diaphragm 2. The comb tooth part 22 can be at least one air escape valve clack 220 formed in the edge position of the vibrating diaphragm 2 by etching. The quantity of the air escape valve clack 220 can be one, two, three or more, which is specifically determined according to the actual design requirements. The air escape valve clack 220 may be a rectangular, sectorial, oval, trapezoid, or S-shaped air escape valve structure that is well known by those skilled in the art.

The comb tooth parts 22 of the present invention may be disposed in the vibrating diaphragm 2. For example, the air escape valve clack 220 is formed in the edge region of the vibrating diaphragm 2, but a free end thereof is still located in the vibrating diaphragm 2.

In another specific embodiment of the present invention, free ends of the comb tooth parts 22 extend to an outer side edge of the vibrating diaphragm 2. During manufacturing, etched slits penetrate through the edge of the vibrating diaphragm 2, such that the air escape valve clack 220 is formed, and the free end of the air escape valve clack 220 is released, referring to FIGS. 2 and 3. The free end of the air escape valve clack 220 of the present invention may be flush with an outer side edge of the vibrating diaphragm 2. That is to say, a radial size from the center of the vibrating diaphragm 2 to the free end of the air escape valve clack 220 is consistent with that from the center of the vibrating diaphragm 2 to the edge of the vibrating diaphragm 2. Or, the free end of the air escape valve clack 220 of the present invention is in a radially indentation state relative to the outer side edge of the vibrating diaphragm 2. That is to say, the radial size from the center of the vibrating diaphragm 2 to the free end of the air escape valve clack 220 is smaller than that from the center of the vibrating diaphragm 2 to the edge of the vibrating diaphragm 2.

Figure 7:
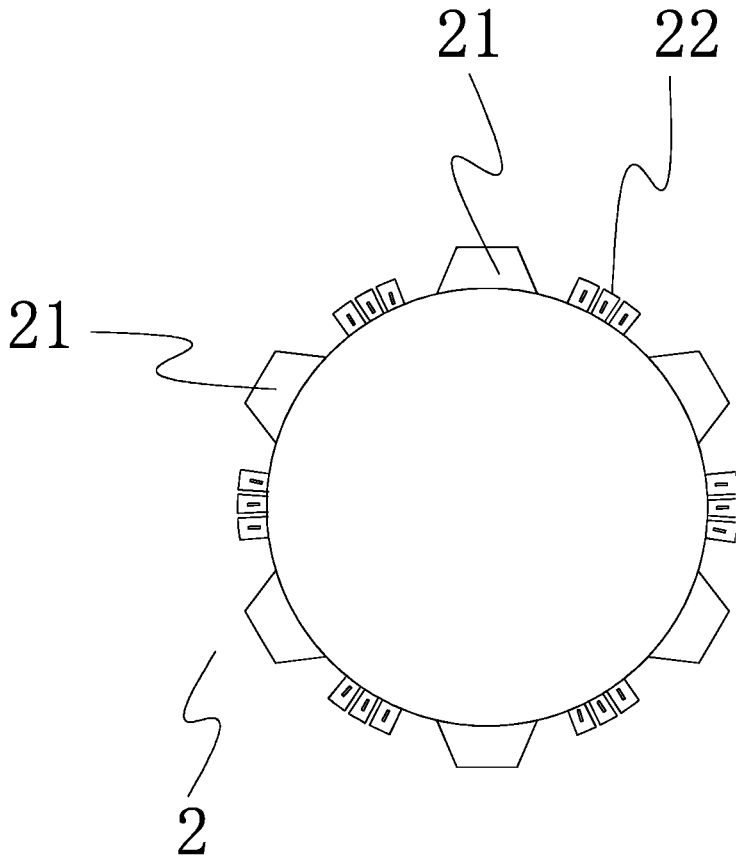
FIG. 7 is a schematic diagram of another implementing structure of a vibrating diaphragm of the present invention.

Of course, for those skilled in the art, the free ends of the comb tooth parts 22 may also be in a radially protruding state relatively to the outer side edge of the vibrating diaphragm 2. That is to say, the free ends of the comb tooth parts 22 extend to the outer side of the edge of the vibrating diaphragm 2, referring to FIG. 7.

The plurality of comb tooth parts of the present invention 22 is distributed in a peripheral direction of the vibrating diaphragm 2 at intervals, thereby realizing pressure relief uniformity in the peripheral direction of the vibrating diaphragm. For example, when the vibrating diaphragm 2 is round, the plurality of comb tooth parts 22 may be uniformly distributed in a circumferential direction of the vibrating diaphragm 2. The quantity of the comb tooth parts 22 can be determined according to the actual needs; for example, six comb tooth parts as shown in FIG. 2 may be selected.

According to the MEMS microphone of the present invention, a position between every two adjacent comb tooth parts 22 on the vibrating diaphragm 2 is connected to the substrate via the first insulating layer 3, and the comb tooth parts 22 on the vibrating diaphragm 2 are at least partially overlapped with the substrate 1. Connecting points between the vibrating diaphragm 2 and the substrate 1 are located between every two adjacent comb tooth parts 22, but no first insulating layer 3 is disposed between the region of the comb tooth parts 22 and the substrate 1; as a result, a certain clearance exists between the region of the comb tooth parts 22 and the substrate 1 and is configured as an airflow circulation channel 6 for airflows to pass by. The sizes of such clearances for example can be 1-2 μm, and need to be specifically decided according to a bias pressure provided by an ASIC chip.

Figure 4:
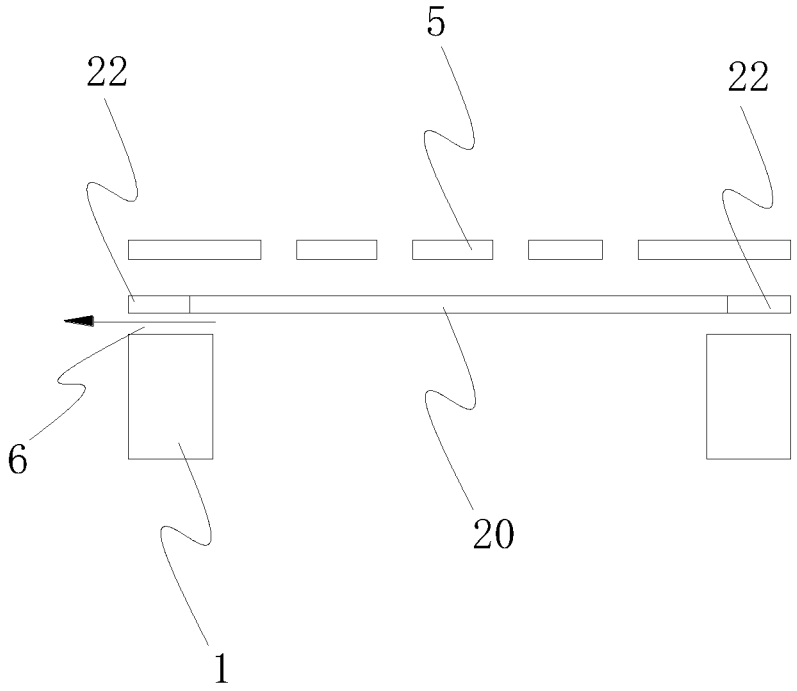
FIGS. 4 to 6 illustrate three different operation states of a microphone of the present invention.

FIG. 1 is a sectional view of connection positions between the microphone and the substrate 1 along the vibrating diaphragm 2 of the present invention. FIG. 4 is a sectional view of the microphone along positions of the comb tooth parts 22 of the vibrating diaphragm 2 of the present invention. The region of the comb tooth parts 22 on the edge of the vibrating diaphragm 2 is suspended above the substrate 1. As a result, the defined airflow circulation channel 6 can be communicated to the outer side of the microphone, thereby facilitating pressure relief For those skilled in the art, the MEMS microphone is obtained by depositing layer by layer, etching layer by layer and subsequent corrosion. That is to say, at the lower side of the vibrating diaphragm layer is originally a whole layer of the first insulating layer. The first insulating layer between the comb tooth parts 22 and the substrate 1 may be corroded by clearances between the air escape valve clacks 220. According to the present invention, preferably, the air escape valve clack 220 is provided with a sacrificial hole 221, referring to FIG. 3. Disposing of the sacrificial hole 221 is not only favorable for rapid corrosion of the first insulating layer, but also can improve a pressure relief capacity of the air escape valve clack 220 per se.

The vibrating diaphragm 2 of the present invention may be a round vibrating diaphragm. In one preferable embodiment of the present invention, referring to FIG. 2, the vibrating diaphragm 2 comprises a vibrating diaphragm main body 20 and a plurality of connecting parts 21 distributed on the edge of the vibrating diaphragm main body 20 at intervals. The connecting parts 21 are in a radially protruding state relatively to the edge of the vibrating diaphragm main body 20, such that the whole vibrating diaphragm 2 is gear-shaped. The connecting parts 21 of the vibrating diaphragm 2 are connected to the substrate 1 via the first insulating layer 3, such that supporting and connecting of the whole vibrating diaphragm 2 on the substrate 1 are realized.

The comb tooth parts 22 are formed in the positions on the vibrating diaphragm main body 20 between every two adjacent connecting parts 21. The vibrating diaphragm main body 20, the connecting parts 21 and the comb tooth parts 22 of the present invention may be formed on the same vibrating diaphragm layer in an etching manner. Such an MEMS process belongs to the common knowledge of those skilled in the art and is not specifically explained herein.

Figure 5:
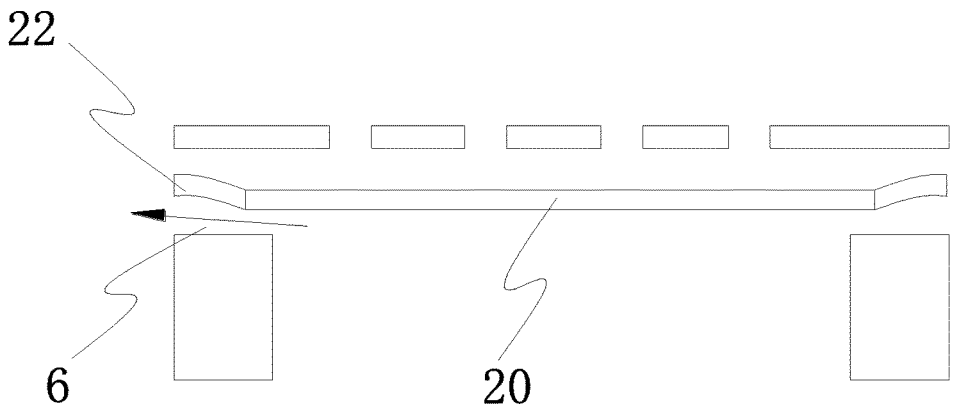
Figure 6:
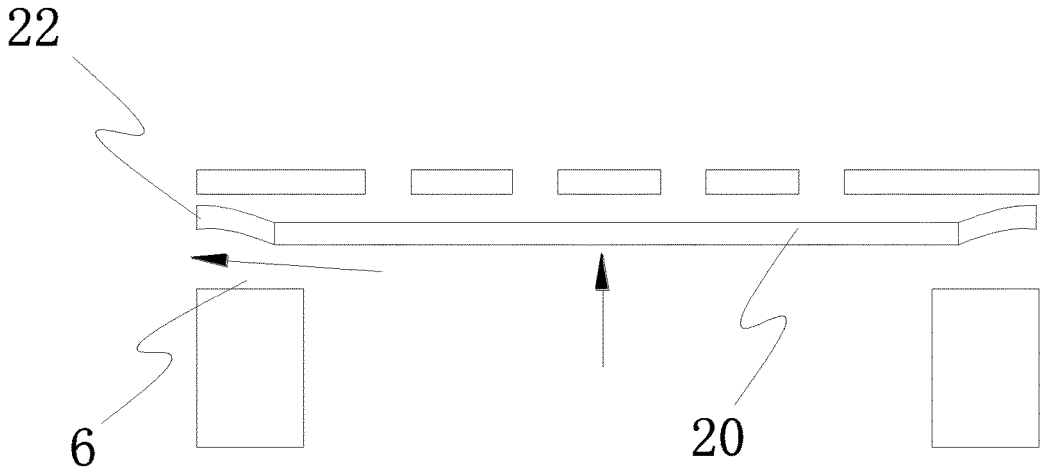

The airflow circulation channel 6 of the present invention has three operation states due to a structural design, referring to FIGS. 4 to 6.

FIG. 4 illustrates a first operation state of the airflow circulation channel 6 of the present invention. When the vibrating diaphragm 2 is in a normal working state, airflows will flow out of the airflow circulation channel 6, thereby meeting requirements of regulating the low frequency performance of the microphone.

FIG. 5 illustrates a second operation state of the airflow circulation channel 6 of the present invention. When the vibrating diaphragm 2 is subjected to a slight overload sound pressure, for example, subjected to the overload sound pressure of 0.2-0.4 MPa, the comb tooth parts 22 on the vibrating diaphragm 2 will be bulged. Therefore, the airflow circulation channel 6 forms a flared structure, such that rapid pressure relief is facilitated and the vibrating diaphragm 2 is protected from being damaged by the overload sound pressure.

FIG. 6 illustrates a third operation state of the airflow circulation channel 6 of the present invention. When the vibrating diaphragm 2 is subjected to a relatively greater overload sound pressure, for example, subjected to the overload sound pressure of 0.4-0.8 MPa, only part of the edge of the vibrating diaphragm 2 is connected to the substrate 1; as a result, the greater overload sound pressure will enable the vibrating diaphragm 2 to be pressed and to be moved, thereby providing a maximal pressure relief path. Meanwhile, the comb tooth parts 22 on the vibrating diaphragm 2 will be bulged. Therefore, the airflow circulation channel 6 forms a flared structure, such that rapid pressure relief is facilitated and the vibrating diaphragm 2 is protected from being damaged by the overload sound pressure.

According to the microphone of the present invention, since the airflow circulation channel 6 communicated with the outside is formed between the region of the comb tooth parts 22 of the vibrating diaphragm 2 and the substrate 1, a sound pressure that the vibrating diaphragm 2 is subjected to can be rapidly relieved by the airflow circulation channel 6, so as to rapidly balance air pressures of inner and outer cavity bodies of the microphone. In addition, the airflow circulation channel 6 can be deformed according to a stress condition per se. Therefore, a size of the airflow circulation channel can be adjusted according to the overload sound pressure applied in real time, and a pressure relief path is provided for protecting the vibrating diaphragm 2.

The airflow circulation channel of the present invention also realizes regulation of the low frequency performance of the MEMS microphone. Meanwhile, due to the structural design of the vibrating diaphragm 2, the airflow circulation channel 6 can greatly improve an impact resistance of the microphone, and can effectively shield dust and particles. The damages to the chips per se caused by intrusion of the dust and particles can be avoided.

According to the microphone of the present invention, an overlapped size between the comb tooth parts 22 on the vibrating diaphragm 2 and the substrate 1 decides a transverse length of the airflow circulation channel 6. The comb tooth parts 22 may be partially overlapped with the substrate 1. Preferably, the comb tooth parts 22 are completely overlapped with the substrate 1.

More preferably, the parts from the comb tooth parts 22 on the vibrating diaphragm 2 to the center of the vibrating diaphragm 2 are overlapped with the substrate 1. That is to say, not only are the comb tooth parts 22 and the substrate 1 completely overlapped together, but also the region from the comb tooth parts 22 on the vibrating diaphragm 2 to the center of the vibrating diaphragm 2 partially extends to be above the substrate 1, and participates in formation of the airflow circulation channel 6. As a result, the transverse size of the airflow circulation channel 6 is greatly enlarged. When a relatively greater overload sound pressure is applied, it is favorable to drive the whole vibrating diaphragm 2 to move, so as to provide a maximal pressure relief path. In addition, a longer airflow circulation channel 6 can effectively prevent the dust and particles from intruding into the chips.

Although some specific embodiments of the present invention have been described in detail by way of example, it should be understood by those skilled in the art that the above examples are merely for the sake of description rather than limiting the scope of the present invention. It should be understood by those skilled that the above embodiments may be modified without departing from the scope and spirit of the present invention. The scope of the present invention is limited by the appended claims.

What is claimed is:

1. A MEMS microphone comprising:

a substrate;

a vibrating diaphragm located above the substrate;

a back electrode located above the substrate; and a plurality of comb tooth parts formed in edge positions of the vibrating diaphragm, wherein:

the plurality of comb tooth parts are distributed in a peripheral direction of the vibrating diaphragm at intervals, a position between every two adjacent comb tooth parts on the vibrating diaphragm is connected to the substrate via an insulating layer, and the comb tooth parts on the vibrating diaphragm are at least partially overlapped with the substrate in such a way that: a clearance exists in an overlapped part of the comb tooth parts and the substrate, the comb tooth parts and the substrate are spaced apart from each other, and the clearance is configured as a channel, a length of the overlapped part of the comb tooth parts and the substrate defining a length of the channel.

2. The MEMS microphone according to claim 1, wherein:
the vibrating diaphragm comprises:
a vibrating diaphragm main body; and
a plurality of connecting parts,
the plurality of connecting parts are distributed on the edge of the vibrating diaphragm main body at intervals and protrude relative to the edge of the vibrating diaphragm main body,
the comb tooth parts are disposed in the positions on the vibrating diaphragm main body between two adjacent connecting parts, and
the connecting parts of the vibrating diaphragm are connected to the substrate via an insulating layer.

3. The MEMS microphone according to claim 2, wherein the vibrating diaphragm main body and the connecting parts are integrally formed by an MEMS process.

4. The MEMS microphone according to claim 1, wherein each comb tooth part comprises at least one air escape valve clack formed by etching the vibrating diaphragm.

5. The MEMS microphone according to claim 4, wherein the air escape valve clack is rectangular, sectorial, oval, trapezoid or S-shaped.

6. The MEMS microphone according to claim 4, wherein the air escape valve clack is provided with a sacrificial hole.

7. The MEMS microphone according to claim 1, wherein parts from the comb tooth parts on the vibrating diaphragm to a center of the vibrating diaphragm and the substrate are overlapped.

8. The MEMS microphone according to claim 1, wherein the clearances between the positions of the comb tooth parts on the vibrating diaphragm and the substrate are approximately 1-2 μm.

9. The MEMS microphone according to claim 1, wherein free ends of the comb tooth parts extend to an outer side edge of the vibrating diaphragm and are flush with the outer side edge of the vibrating diaphragm or are in an indentation state relative to the outer side edge of the vibrating diaphragm.

10. The MEMS microphone according to claim 1, wherein free ends of the comb tooth parts are in a radially protruding state relative to the outer side edge of the vibrating diaphragm.

* * * * *